US009797165B2

(12) United States Patent
Geringer et al.

(10) Patent No.: US 9,797,165 B2
(45) Date of Patent: Oct. 24, 2017

(54) ELECTRIC LATCH RETRACTION BAR

(71) Applicant: 1 ADOLFO, LLC, Camarillo, CA (US)

(72) Inventors: Arthur V. Geringer, Oak Park, CA (US); David A. Geringer, Camarillo, CA (US)

(73) Assignee: SECURITY DOOR CONTROLS, Camarillo, CA (US)

( * ) Notice: Subject to any disclaimer, the term of this patent is extended or adjusted under 35 U.S.C. 154(b) by 117 days.

(21) Appl. No.: 14/469,915

(22) Filed: Aug. 27, 2014

(65) Prior Publication Data

US 2014/0361550 A1 Dec. 11, 2014

Related U.S. Application Data

(63) Continuation of application No. 12/616,564, filed on Nov. 11, 2009, now Pat. No. 8,851,530.
(Continued)

(51) Int. Cl.
*E05B 65/10* (2006.01)
*E05B 47/00* (2006.01)
(Continued)

(52) U.S. Cl.
CPC ..... *E05B 47/0001* (2013.01); *E05B 47/0012* (2013.01); *E05B 47/023* (2013.01);
(Continued)

(58) Field of Classification Search
CPC .... E05B 47/001; E05B 47/002; E05B 47/004; E05B 47/0012; E05B 47/02; E05B 47/023; E05B 2047/0015; E05B 2047/0016; E05B 2047/0023; E05B 63/0065; E05B 65/10; E05B 65/1046; E05B 65/1053; E05B 65/1093; E05B 47/00; E05B 47/0001; E05B 47/0002; E05B 47/0003; E05B 47/0004; E05B 47/06; E05B 47/0603; E05B 2047/0007; E05B 2047/0008; E05B 2047/0013; E05B 2047/0073
See application file for complete search history.

(56) References Cited

U.S. PATENT DOCUMENTS 1,948,217 A 2/1934 Goodwin, Sr. ..... 70/280
2,504,408 A 4/1950 Griffin ..... 74/89.37
(Continued)

FOREIGN PATENT DOCUMENTS

DE WO 2006015769 A1 * 2/2006 ..... E05B 65/10
EP 233094 A1 8/1987
(Continued)

OTHER PUBLICATIONS

Omega Engineering. Stepper Motors, Aug. 24, 2008.

*Primary Examiner* — Alyson M Merlino
(74) *Attorney, Agent, or Firm* — Koppel, Patrick, Heybl & Philpott

(57) ABSTRACT

An electric latch retraction device comprising a housing for receiving a plurality of internal components of the electric latch retraction device. An actuator mechanism is included in the housing, the actuator mechanism is adapted to impart linear movement on a latch, such that the latch is retracted towards the housing. A holding mechanism is also included in the housing, the holding mechanism holds the latch in a fully retracted position.

20 Claims, 3 Drawing Sheets

Related U.S. Application Data

(60) Provisional application No. 61/199,560, filed on Nov. 17, 2008.

(51) Int. Cl.
*E05B 47/02* (2006.01)
*E05B 63/00* (2006.01)
*E05C 19/16* (2006.01)

(52) U.S. Cl.
CPC ..... *E05B 63/0056* (2013.01); *E05B 65/1046* (2013.01); *E05B 65/1053* (2013.01); *E05B 63/0065* (2013.01); *E05B 65/1093* (2013.01); *E05B 2047/0016* (2013.01); *E05B 2047/0023* (2013.01); *E05B 2047/0067* (2013.01); *Y10S 292/65* (2013.01); *Y10T 70/5159* (2015.04); *Y10T 292/097* (2015.04); *Y10T 292/0908* (2015.04); *Y10T 292/1014* (2015.04); *Y10T 292/1021* (2015.04); *Y10T 292/1082* (2015.04); *Y10T 292/11* (2015.04)

(56) References Cited

U.S. PATENT DOCUMENTS

| | | | | |
|---|---|---|---|---|
| 2,765,648 | A | 10/1956 | Hatcher | 70/264 |
| 3,576,119 | A | 4/1971 | Harris | |
| 3,614,145 | A | 10/1971 | Zawadski | |
| 3,767,238 | A | 10/1973 | Zawadski | |
| 3,854,763 | A | 12/1974 | Zawadzki et al. | 292/201 |
| 4,006,471 | A | 2/1977 | Pappas | |
| 4,167,280 | A | 9/1979 | Godec et al. | 292/41 |
| 4,257,631 | A | 3/1981 | Logan | |
| 4,328,985 | A | 5/1982 | Logan | |
| 4,344,647 | A | 8/1982 | VanDerLinden | 292/201 |
| 4,351,552 | A | 9/1982 | VanDerLinden | 292/201 |
| 4,354,699 | A | 10/1982 | Logan | |
| 4,384,738 | A | 5/1983 | Floyd | 292/92 |
| 4,519,640 | A | 5/1985 | Mombelli | 292/33 |
| 4,545,606 | A | 10/1985 | Vodra | 292/92 |
| 4,631,528 | A | 12/1986 | Handel et al. | |
| 4,652,028 | A | 3/1987 | Logan et al. | |
| 4,709,950 | A | 12/1987 | Zortman | |
| 4,720,128 | A | 1/1988 | Logan et al. | |
| 4,784,415 | A | 11/1988 | Malaval | |
| 4,796,931 | A | 1/1989 | Heid | |
| 4,801,163 | A | 1/1989 | Miller | 292/92 |
| 4,821,456 | A | 4/1989 | Nogaki | 49/362 |
| 4,875,722 | A | 10/1989 | Miller et al. | |
| 4,976,476 | A | 12/1990 | Cross et al. | 292/92 |
| 5,072,973 | A | 12/1991 | Gudgel et al. | 292/55 |
| 5,169,185 | A | 12/1992 | Slaybaough et al. | |
| 5,219,385 | A | 6/1993 | Yeh | |
| 5,246,258 | A | 9/1993 | Kerschenbaum et al. | 292/144 |
| 5,322,332 | A | 6/1994 | Toledo et al. | |
| 5,340,171 | A | 8/1994 | Slaybuagh et al. | |
| 2,366,613 | A | 1/1995 | Gotthard | 49/252 |
| 5,410,301 | A | 4/1995 | Dawson et al. | 340/5.33 |
| 5,429,399 | A | 7/1995 | Geringer et al. | |
| 5,507,120 | A | 4/1996 | Current | 49/340 |
| 5,605,362 | A | 2/1997 | Surko, Jr. | |
| 5,630,631 | A | 5/1997 | Iwamoto et al. | |
| 5,823,582 | A | 10/1998 | Frolov et al. | |
| 5,988,708 | A | 11/1999 | Frolov et al. | 292/92 |
| 6,048,000 | A | 4/2000 | Geringer et al. | 292/92 |
| 6,104,594 | A | 8/2000 | Frolov et al. | 361/152 |
| 6,116,661 | A | 9/2000 | Overbuy et al. | 292/92 |
| 6,189,939 | B1 | 2/2001 | Zehrung | 292/92 |
| 6,324,789 | B1 | 12/2001 | Stephen | 49/362 |
| 6,386,597 | B1 | 5/2002 | Walsh, III | 292/92 |
| 6,394,508 | B1 | 5/2002 | Zehrung | 292/92 |
| 6,565,130 | B1 | 5/2003 | Walsh, III | 292/92 |
| 6,769,723 | B2 | 8/2004 | Cohrs et al. | 292/92 |
| 6,786,519 | B2 | 9/2004 | Gartner | 292/195 |
| 7,000,954 | B2 | 2/2006 | Cohrs et al. | 292/92 |
| 7,102,475 | B2 | 9/2006 | Nakagawa et al. | 335/234 |
| 7,484,777 | B2 | 2/2009 | Condo et al. | |
| 7,503,597 | B2 | 3/2009 | Cohrs et al. | 292/92 |
| 7,536,885 | B1 | 5/2009 | Ross et al. | 70/92 |
| 7,862,091 | B2 | 1/2011 | Escobar | 292/93 |
| 7,883,123 | B2 | 2/2011 | Condo et al. | |
| 2004/0189018 | A1 | 9/2004 | Geringer et al. | 292/251.5 |
| 2005/0104381 | A1 | 5/2005 | Whitaker et al. | 292/190 |
| 2006/0082162 | A1 | 4/2006 | Escobar | 292/144 |
| 2008/0295550 | A1 | 12/2008 | Schmidt | 70/144 |
| 2009/0127869 | A1 | 5/2009 | Condo et al. | |
| 2010/0218569 | A1 | 9/2010 | Hunt et al. | 70/263 |

FOREIGN PATENT DOCUMENTS

| | | | | |
|---|---|---|---|---|
| EP | 485248 | A1 | 5/1992 | |
| EP | 1031688 | A1 | 8/2000 | |
| EP | 1031689 | A1 | 8/2000 | |
| FR | 26222240 | A1 | 4/1989 | |
| FR | 2653480 | A1 | 4/1991 | |
| FR | 2659379 | A1 * | 9/1991 | E05B 47/0002 |
| JP | 11107595 | A | 4/1999 | |
| WO | WO9204519 | A1 | 3/1992 | |
| WO | WO2008010876 | A2 | 1/2008 | |

* cited by examiner

ELECTRIC LATCH RETRACTION BAR

This application is a continuation of, and claims the benefit of, U.S. patent application Ser. No. 12/616,564 to Geringer et al, filed on Nov. 11, 2009, which claims the benefit of provisional application Ser. No. 61/199,560 to Geringer et al., filed on Nov. 17, 2008.

BACKGROUND OF THE INVENTION

Field of the Invention

This invention relates to latch mechanisms for doors and in particular to door latch mechanisms comprising a latch retraction bar.

Description of the Related Art

Door locking mechanisms and security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

One type of a commonly used exit device is a push bar or push rail ("push bar") actuated latch retraction device installed on the inside of a door. When sufficient pressure is applied to the bar it depresses causing the door latch to retract from the door frame, allowing the door to be opened. These types of exit devices are typically required by fire or building codes and are used in public buildings where many people may be gathered. The devices allow for safe and quick egress from inside of the building, such as in the case of an emergency. These devices allow for this egress while keeping the door locked to those trying to enter the building from the outside.

U.S. Pat. No. 6,116,661 describes an electric dogging mechanism for a push bar exit device consisting of slidable plate and armature which are attracted to an electric coil when the coil is energized. The slidable plate is connected to a push bar mechanism. After the push bar is depressed, retracting the exit device latch, the coil is energized attracting and holding the armature to the coil. This holds the push bar depressed and the latch retracted by the connection of the slidable plate to the push bar mechanism.

Electrically operated push bar exit devices can also be used in applications where they can be operated by a card reader or keypad from outside to allow access through a door that also serves as an exit bar latch retraction device from inside. Other applications allow for these devices to allow operation with power door operators, allowing the latch to retract on command such as through a timed schedule. These timed schedules can be implemented at facilities that operate on a fixed schedule, such as schools.

Some current implementations of these electric exit devices utilize solenoids to retract the latch bolt, which can require a relatively high operating current to reliably retract the latch bolt and overcome initial friction. Another current implementation uses a motor to retract the latch bolt, with the motor pulling back the bar which causes the latch bolt to retract. A switch can be included to detect when the bar reaches the fully retracted position, at which point the motor is turned off. In this design, the motor does not shut off until the push rail is fully retracted as sensed by the switch. Internal components of the exit device can bind or otherwise prevent the motor from fully retracting the latch bolt. This causes the motor to overwork and produces a continuous drive to the motor which can ultimately burn it out.

PCT International Publication No. WO 2008/010876 A2 to Sargent teaches that a stepper motor type linear actuator can be used and the retraction distance can electronically be controlled by counting the rotational steps of the motor. This electronic monitoring or "rotation counting" is claimed to be superior to having a fixed switch controlling the motor function however it is simply a means of eliminating the separate monitor switch and still suffers the same susceptibility to failure from wear of mechanical parts through the life of the device. The electronic user adjustable latch control can create more of an opportunity for device problems through miss adjustment. The means of holding the latch and linear actuator in the retracted position is accomplished by electronically holding the stepper motor in the actuator in a "stalled mode". This requires that the motor remains powered.

PCT International Publication WO 2006/015769 to Dorma also discloses a means of retracting the latch through linear movement. There is no mention of how the patented mechanism would be held in the retracted position.

SUMMARY OF THE INVENTION

The present invention provides an electric latch retraction push bar exit device that utilizes a motor to impart linear movement on the latch and to retract the latch. When the latch is retracted it is held in that position by a holding mechanism and the motor can be turned off. This allows for power saving and reduced wear on the motor and surrounding assemblies. A bias spring is included to return the latch to the latched condition if power is lost to the exit device or if the controller signals the holding mechanism to release the latch.

These and other aspects and advantages of the invention will become apparent from the following detailed description and the accompanying drawings which illustrate by way of example the features of the invention.

DETAILED DESCRIPTION OF THE INVENTION

Figure 3:
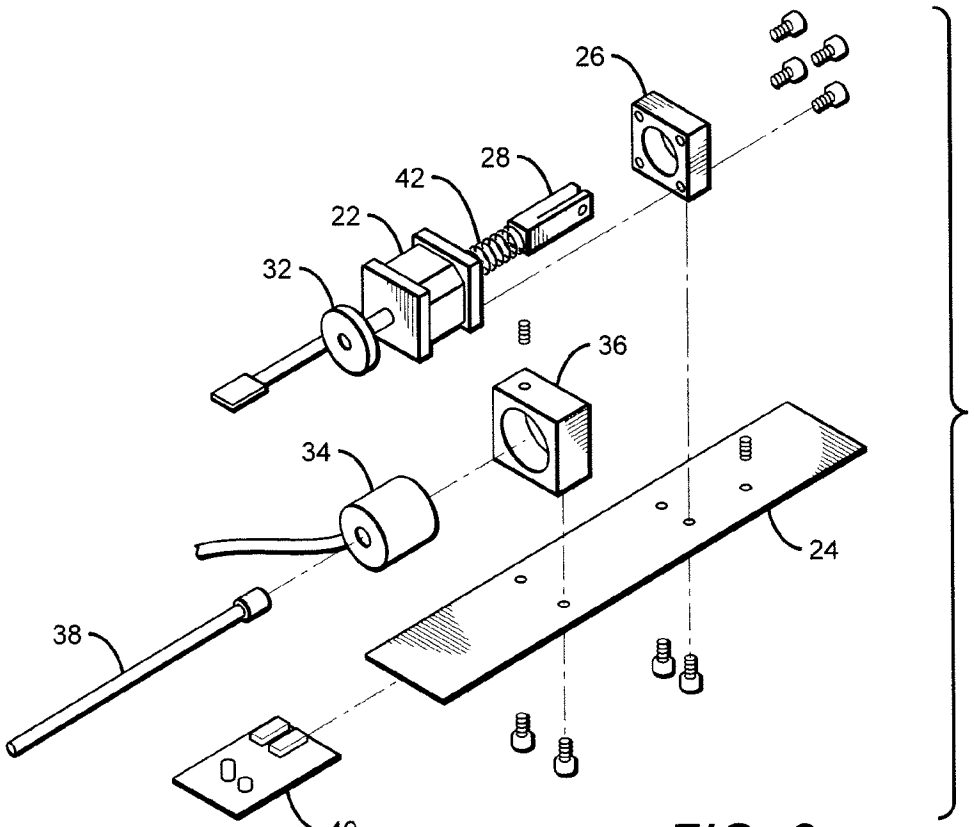
FIG. 3 is an exploded view of a motor and holding magnet assembly that can be utilized in one embodiment of an electric latch retraction push bar exit device according to the present invention.

The present invention provides an electric latch retraction push-bar exit device ("push-bar exit device"). SDC where the latch can be retracted through the standard pushing action on the push-bar. The exit devices according to the present invention can comprise secondary mechanisms for retracting the latch, such as through an electric motor. On some embodiments, the motor can be internal to the device housing and can comprise a stepper motor type linear actuator to retract the latch. When the actuator has moved to the retracted (unlatched) position, a holding magnet can be activated to hold the actuator in the unlatched position to allowing the motor to be switched off. Many different holding magnets can be used such as a magnetic holding coil.

Upon loss of power or when controller electronics remove power from the magnetic holding coil the actuator can be returned to the at-rest or latched position. In some embodiments biasing springs can be used to return the latch to the locked position and in one embodiment a combination of an actuator biasing spring and a latch biasing spring can reverse the linear movement of the actuator and cause the device to return to the latched position.

It is understood that when an element or component is referred to as being "on", "connected to" or "coupled to" another element, it can be directly on, connected to or coupled to the other element or intervening elements may also be present. Furthermore, relative terms such as "front", "back", "inner", "outer", "upper", "above", "lower", "beneath", and "below", and similar terms, may be used herein to describe a relationship of one component of element to another. It is understood, however, that these terms are intended to encompass different orientations of the device in addition to the orientation depicted in the figures.

Although the terms first, second, etc. may be used herein to describe various elements or components these elements and components should not be limited by these terms. These terms are only used to distinguish one element or component from another element or component. Thus, a first element or component discussed below could be termed a second element or component without departing from the teachings of the present invention.

Embodiments of the invention are described herein with reference to certain illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the elements or components illustrated herein but are to include deviations in shapes that result, for example, from manufacturing. Thus, the regions illustrated in the figures are schematic in nature and their shapes are not intended to illustrate the precise shape of an element or component and are not intended to limit the scope of the invention.

Figure 1:
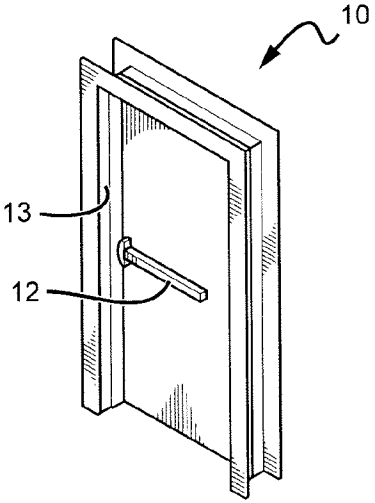
FIG. 1 is perspective view of a door utilizing one embodiment of an electric latch retraction push bar exit device according to the present invention.
Figure 2:
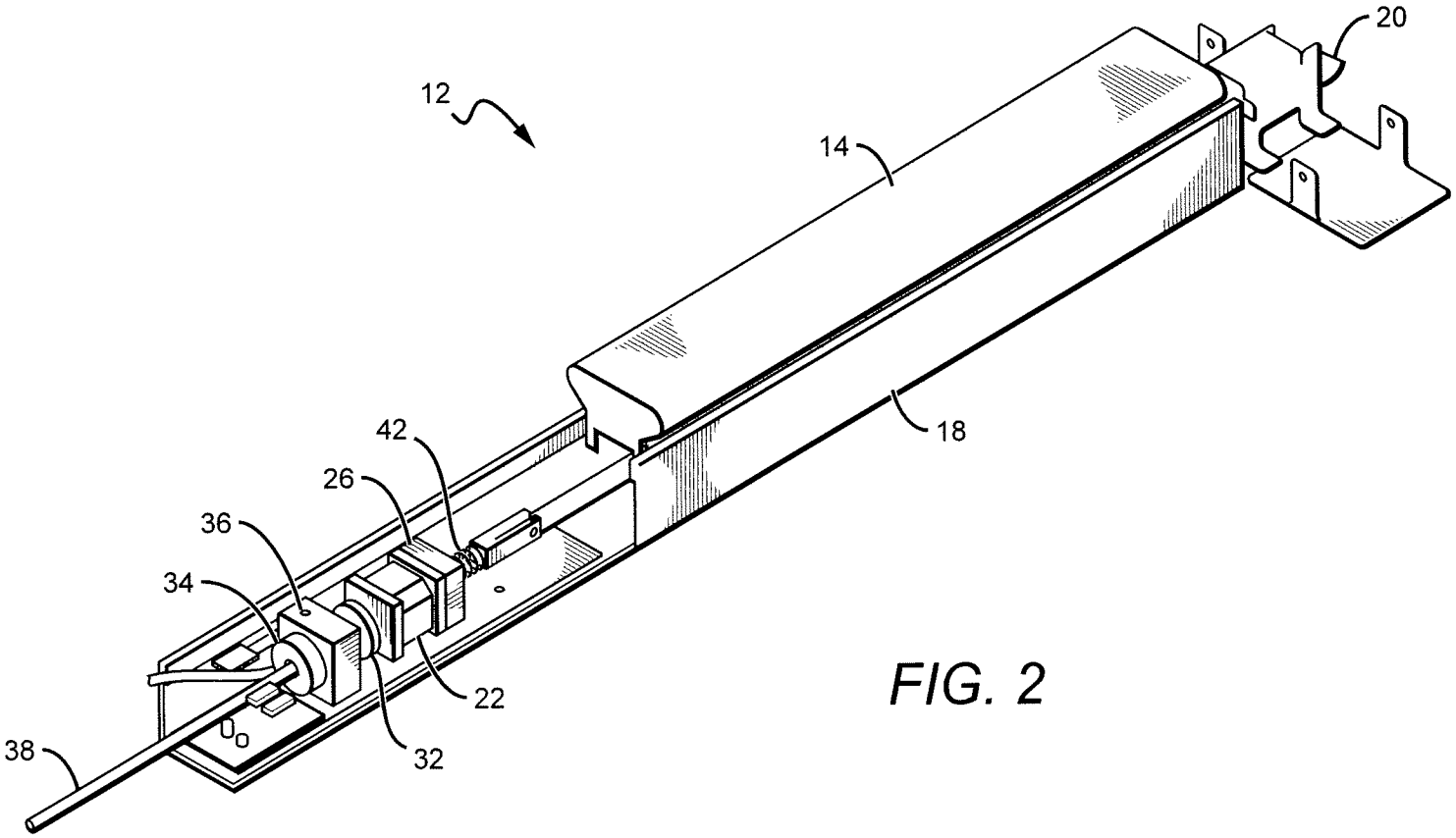
FIG. 2 is a perspective view of one embodiment of an electric latch retraction push bar exit device according to the present invention.
Figure 4:
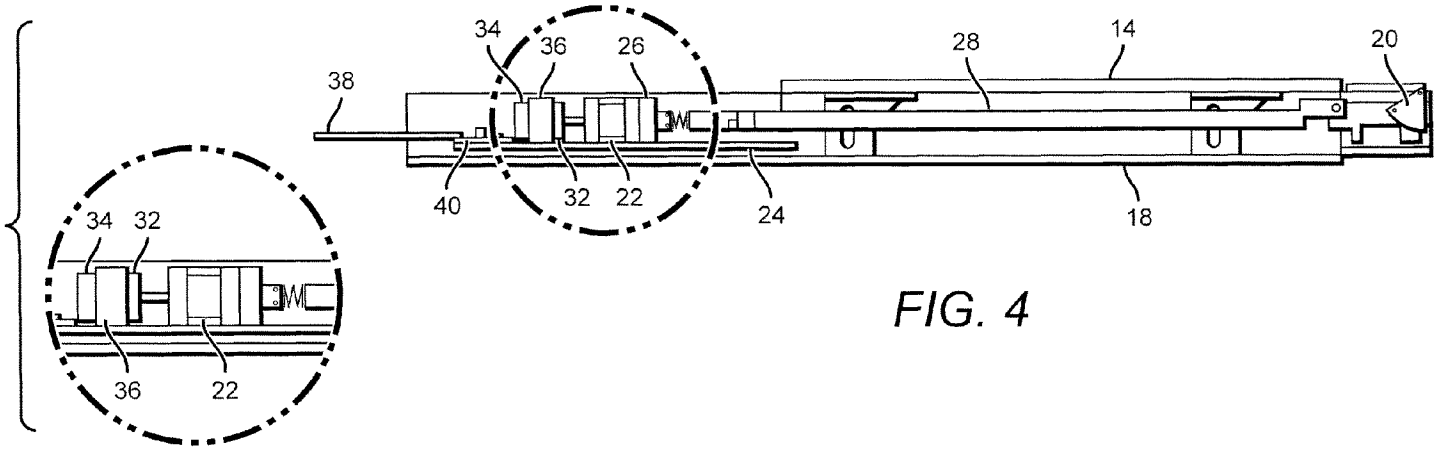
FIG. 4 is a plan view of the latch retraction push bar exit device shown in FIG. 2 in the unlatched condition.
Figure 5:
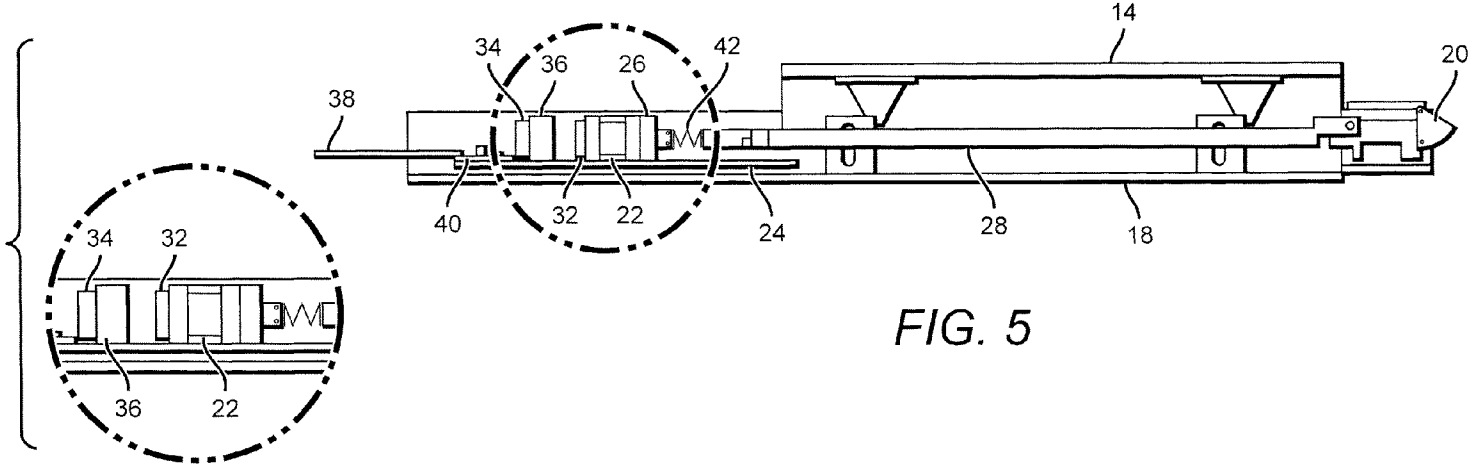
FIG. 5 is a plan view of the latch retraction push bar exit device shown in FIG. 2 in the latched condition.

FIG. 1 shows one embodiment of a door 10 utilizing a push-bar exit device 12 according to the present invention. The push-bar exit device 12 is mounted in convention manner to the door 12 with a horizontal orientation and location that allow for the exit device's latch to engage a latch opening in the door frame 13. When engaged the door 10 is prevented from opening, when the latch is retracted from latch opening the door 10 can open. As with convention devices, depressing the push-bar 14 causes the latch to retract from the latch opening to allow opening of the door 10.

Referring now to FIGS. 2-5, the push-bar exit device comprises a housing 18 with the push-bar 14 movably mounted to the housing so that it can be depressed. As with most conventional push-bar exit devices, this action can retract the latch so that it is partially within the housing. As the push-bar 14 is depressed it causes a latch 20 to retract toward the housing. As discussed above, when the latch 20 is retracted the door utilizing the push-bar exit device 12 can be opened. Many different known mechanisms can be used to cause the latch 20 to retract as the push-bar 14 is depressed, and it is understood that each of these known mechanisms can be utilized in different embodiments of push-bar exit devices according to the present invention.

As mentioned above, push bar exit devices according to the present invention are arranged so that latch 20 can be retracted in a manner beyond the manual pushing of the push-bar 14. These can include many different types of linear actuators. In one embodiment, the latch 20 can be retracted in response to an electrical signal, and many different devices and mechanisms can be used to retract the latch 20 is response to an electrical signal. In one embodiment, an electric motor 22 can be used to retract the latch, with motor 22 mounted in place within the housing 18. An adjustment plate 24 can be included within the housing 18 with the motor 22 mounted to the adjustment plate 24 by a mounting block 26. As mentioned above, many different types of motors can be used with a suitable motor 22 such as a rotary or step motor.

The motor 22 can impart linear movement on the latch 20 using many different mechanisms. In one embodiment, the motor 22 can comprise an internal nut that turns when an electrical signal is applied to the motor 22. The housing 18 can also have internal linkage 28 that connects at one end to the latch 20 and at the other end to the motor 22. The motor end of the linkage 28 has a threaded section that mates with the motor's internal nut, and as the nut turns on the threaded section linear movement is imparted on the latch 20 through the linkage 28.

The motor further comprises an armature 32 that extends from the motor 22 as the latch 20 is retracted. A holding magnet 34 is mounted to the adjustment plate 24 by a magnet mounting block 36, with the magnet 34 in alignment with the armature 32. Many different magnets can be used, with a suitable one being an electrically actuated magnetic coil. An actuator switch/sensor 38 is mounted integral to the magnet 34 and as mentioned above, in the path of travel of the armature 32 to sense its position relative to the magnet 34.

A controller 40 can be utilized to control operation of the push-bar exit device 12, and in different embodiments the controller 40 can be remote or local to the exit device 12. The controller can communicate with the exit device using many different "hard-wire" and wireless communication links. In the embodiment shown, the controller comprises commercially available electronics interconnected in conventional way, and in different embodiments the controller 40 can perform many different functions. In the embodiment shown, when the armature 32 engages the sensor 38, the sensor 38 signals the controller 40 to turn the motor off to allow the actuator mechanism to "coast" to the fully retracted position. This coasting action is designed to compensate for manufacturing tolerances in the internal components of the exit device, including but not limited to the adjustment plate 24 and linkage 28. This allows for a "self adjusting" feature eliminating the need to readjust the device linkage as the exit device 12 wears from use.

The controller 40 is also designed to deliver a "timed" period of motor activation. This "timed" period is set to be slightly longer than is needed to retract the latch 20. The controller 40 monitors the actuator sensor 38 to determine when to remove motor power to enable the "coasting" effect and ensure a positive mating of the armature 32 against the magnet 36.

Should the sensor 38 not indicate that the latch 20 has not been retracted and "timed" motor active period has expired, the power to the motor 22 can be turned off. A rest period for motor cooling is initiated and the latch retraction cycle can be attempted again. The motor 22 will not be damaged in the event of binding of the panic device due to door alignment problems or door preload.

As mentioned above, when the armature 32 moves to the retracted position and engages the sensor 38, the armature contacts the magnet. The magnet holds the armature 32 in the retracted position, allows the motor to be switched off while still keeping the device in the unlatched condition. This allows for keeping the exit device 12 in the unlatched condition while not consuming power by continued activation of the motor. The power needed to energize the magnet 34 is less than that consumed by the motor 22, with this arrangement realizing significant reduction in power consumption compared to similar devices without a magnet 34.

A biasing spring 42 is included on the linkage 28 biasing the linkage 28 to the latch 20 to the latched condition. If power is removed from the magnet 34, either by the controller or by loss of power to the exit device 12, the bias spring reverses the linear motion of the motor and causes the exit device 12 to return to the latched condition.

Although the present invention has been described in detail with reference to certain configurations thereof, other versions are possible. Therefore, the spirit and scope of the invention should not be limited to the versions described above.

We claim:

1. An electric latch retraction device comprising:

a housing containing an electric motor wherein said electric motor is adapted to impart linear movement on a latch, such that said latch is retracted towards said housing and toward a fully retracted position;

a holding mechanism mounted in said housing, wherein said electric motor comprises an armature adapted to extend from said electric motor and engage said holding mechanism when said latch is in said fully retracted position, said holding mechanism adapted to hold said latch in said fully retracted position with a holding strength sufficient to hold said latch in said fully retracted position with said electric motor in an off state and wherein said latch is released from said fully retracted position when said holding mechanism is in an off state and said electric motor is in said off state; and a sensor, said sensor configured to engage said armature and sense the position of said armature.

2. The electric latch retraction device of claim 1, wherein said sensor is configured to signal a controller to place said motor in said off state when said sensor engages said armature during retraction of said latch.

3. The electric latch retraction device of claim 2, wherein said armature extends from said electric motor as said latch is retracted towards said housing.

4. The electric latch retraction device of claim 2, wherein said armature is magnetically conductive.

5. The electric latch retraction device of claim 1, wherein said holding mechanism is magnetically conductive.

6. The electric latch retraction device of claim 1, wherein said holding mechanism is an electrically actuated magnetic coil.

7. The electric latch retraction device of claim 1, said electric motor comprising an internal mechanism adapted to receive an internal linkage.

8. The electric latch retraction device of claim 7, wherein said internal linkage couples said latch to said electric motor, said internal linkage is adapted to mate with said internal mechanism.

9. The electric latch retraction device of claim 8, said internal linkage comprising a threaded section to mate with said internal mechanism to impart linear movement on said latch.

10. The electric latch retraction device of claim 8, wherein said internal mechanism is a nut, said internal linkage mating with said nut to impart linear movement on said latch.

11. The electric latch retraction device of claim 1, wherein said electric motor is a rotary motor.

12. The electric latch retraction device of claim 1, wherein said electric motor is a step motor.

13. An electric latch retraction device comprising:

a housing containing a plurality of internal components of said electric latch retraction device, said internal components comprising an actuator mechanism adapted to impart linear movement on a latch;

said internal components further comprising a magnet mounted in said housing, said magnet adapted to hold said latch in a fully retracted position, wherein said internal components further comprise an armature adapted to extend from said actuator mechanism and engage said magnet when said latch is in said fully retracted position;

a bias spring in said housing, said bias spring adapted to position said latch in a latched position, wherein said latch is released from said fully retracted position when both said actuator mechanism and said magnet are in an off state; and a sensor, said sensor configured to engage said armature and sense the position of said armature.

14. The electric latch retraction device of claim 13, wherein said internal components further comprise an internal linkage, said internal linkage coupling said latch to said actuator mechanism.

15. The electric latch retraction device of claim 14, wherein said bias spring is included on said internal linkage, said bias spring located on an actuator mechanism end of said internal linkage.

16. The electric latch retraction device of claim 13, wherein said bias spring reverses the linear motion caused by said actuator mechanism when said latch is released from said retracted position.

17. The electric latch retraction device of claim 13, wherein said bias spring reverses the linear motion caused by said actuator mechanism when said magnet is in said off state.

18. An electric latch retraction device comprising:

a housing containing an electric motor, wherein said electric motor is adapted to impart linear movement on a latch, such that said latch is retracted towards said housing and towards a fully retracted position; and a magnetically conductive holding mechanism mounted in said housing, wherein said electric motor comprises an armature adapted to extend from said electric motor and engage said magnetically conductive holding mechanism when said latch is in said fully retracted position, said magnetically conductive holding mechanism adapted to hold said latch in said fully retracted position with a holding strength sufficient to hold said latch in said fully retracted position with said electric motor in an off state, wherein said latch is released from said fully retracted position when said magnetically conductive holding mechanism is in an off state and said electric motor is in said off state; and a sensor, said sensor configured to engage said armature and sense the position of said armature.

19. The electric latch retraction device of claim 13, wherein said sensor is configured to signal a controller to place said actuator mechanism in said off state when said sensor engages said armature during retraction of said latch.

20. The electric latch retraction device of claim 18, wherein said sensor is configured to signal a controller to place said electric motor in said off state when said sensor engages said armature during retraction of said latch.

* * * * *